US005191725A

United States Patent [19]

Wohlgenannt et al.

[11] Patent Number: 5,191,725

[45] Date of Patent: Mar. 9, 1993

[54] VENTING SYSTEM FOR HEAT TREATING FLAT MATERIAL WEBS

[75] Inventors: Horst Wohlgenannt, Bregenz; Adolf Mueller, Weissensberg, both of Fed. Rep. of Germany

[73] Assignee: Lindauer Dornier Gesellschaft mbH, Lindau, Fed. Rep. of Germany

[21] Appl. No.: 673,803

[22] Filed: Mar. 22, 1991

[30] Foreign Application Priority Data

Mar. 23, 1990 [DE] Fed. Rep. of Germany ..... 4009313

[51] Int. Cl.[5] ..... F26B 13/00

[52] U.S. Cl. ..... 34/155; 34/219

[58] Field of Search ..... 34/155, 156, 160, 23, 34/219

[56] References Cited

U.S. PATENT DOCUMENTS 3,739,490 6/1973 Comstock .
4,085,522 4/1978 Stroszynski ..... 34/156
4,170,075 10/1979 Scott .
4,286,392 9/1981 Viland .
4,341,024 7/1982 Witkin ..... 34/156
4,575,952 3/1986 Bodenan et al. ..... 34/156

FOREIGN PATENT DOCUMENTS 388167 2/1933 United Kingdom .
1207827 10/1970 United Kingdom .
1579066 11/1980 United Kingdom .
1583199 1/1981 United Kingdom .

*Primary Examiner*—Henry A. Bennet
*Attorney, Agent, or Firm*—W. G. Fasse

[57] ABSTRACT

A venting system for heat treating flat material webs or films has a drying chamber with a centrally arranged single blower for supplying treatment medium, such as heated and cleaned air, to the surfaces of the flat material. Air guide channels and ducts are so arranged that a single blower is fully sufficient while still obtaining a defined suction withdrawal of the air that has contacted the flat material surfaces. Sets of blowing nozzles face the surfaces of the flat material and are arranged for cooperation with suction nozzles for the return of the treatment medium to the suction side of the blower in a substantially closed treatment medium circulating circuit.

10 Claims, 5 Drawing Sheets

VENTING SYSTEM FOR HEAT TREATING FLAT MATERIAL WEBS

FIELD OF THE INVENTION

The invention relates to a venting system for heat treating flat material webs. More specifically, the present system permits exposing a flat material web travelling through a treatment chamber to a flowing gaseous medium that is supplied into the treatment chamber through distribution channels for feeding the gaseous medium crosswise to the feed advance direction of the flat material web, whereby the gaseous flow is supplied and withdrawn in a treatment medium circulating flow process.

BACKGROUND INFORMATION

Treatment chambers for the above purposes comprise a closed heat insulating housing having an inlet slot and an exit slot for the flat material web. Slotted nozzles are arranged as nozzle sets and reach into the housing to cause the treatment medium flow to pass crosswise to the feed advance direction of the flat material web. The nozzle sets extend across the width of the material web and several such sets are arranged in a row as viewed in the feed advance direction. The slotted nozzle sets are connected to blower means for supplying and withdrawing the gaseous treatment medium.

It is known to treat flat material webs of thermoplastic synthetic film for improving certain physical characteristics of such films or webs. The treatment is applied immediately following an extrusion, a calendering, or a pouring of the film, whereby suitable treatment equipment is used in treatment chambers for stretching or fixing the flat material web also referred to as film herein.

Another type of treatment of such films involves coating the films with liquid media and subsequently passing the coated films through a drying chamber or chambers.

One heat treatment in a known apparatus involves the passing of a temperature controlled gaseous medium, preferably air, through a plurality of slotted nozzles across the entire width of the material web crosswise to the feed advance direction. The slotted nozzles are arranged as mentioned, in a row as viewed in the feed advance direction and extend across the entire film width either on one or both sides of the film. In order to avoid heat loss as much as possible, the treatment chambers are substantially closed, except for an entrance and an exit for the material web or film. In addition, the treatment chamber or chambers are well heat insulated.

U.S. Pat. No. 4,170,075 discloses a drying chamber as part of a treatment plant, with a blowing nozzle arrangement suitable for treating web or sheet-type flat materials. The blowing nozzles are arranged crosswise to the feed advance direction of the web and in a row as well as above and below the material web. The nozzles reach across the width of the web. These blowing nozzles are supplied with a gaseous medium by at least two blowers which blow into medium distribution channels. One blower is mounted on each side of the drying chamber longitudinal axis on the inner wall of the drying chamber and below the drying chamber bottom. The medium distribution channels include a vertically arranged medium channel section on the inner chamber wall, leading into further distribution channel sections arranged below and above the blowing nozzles and extending at a right angle to the longitudinal blowing nozzle axis. The vertical channel sections and the horizontal channel sections form a channel unit.

In the known apparatus the withdrawal of the gaseous medium from the drying chamber does not take place in a defined manner. As a result, it is possible that the gaseous medium can travel from one drying chamber or cell into another. Such uncontrolled flow or travel of the gaseous medium is undesirable because it results in the application of gaseous drying flows having different temperatures in different areas on the surface of the film to be dried, whereby exposure of the film to different temperatures at different times during its travel through the drying chamber causes surface defects in the film or material web. Such defects are referred to as "schlieren" which in the form of streaks or discolorations make the film unsightly. Another disadvantage of the relatively uncontrolled flow of the drying medium in the conventional apparatus leads to heat losses due to different temperatures in the drying medium circulating circuit. Another conventional disadvantage is seen in that a plurality, at least two, blowers must be used for each drying chamber in order to cause the gaseous drying medium to flow through the channel system to the blowing nozzles and onto the material web or film.

OBJECTS OF THE INVENTION

In view of the foregoing it is the aim of the invention to achieve the following objects singly or in combination:

to avoid the streaking and discoloration of the film or material web by the drying process;

to reduce the number of blowers needed for each drying chamber while still maintaining an effective drying operation and assuring a defined or controlled withdrawal of the gaseous drying medium once it has been applied to the material web; and to construct individual drying chambers in such a way that a plurality of such chambers may be arranged in a row to assemble a drying system.

SUMMARY OF THE INVENTION

The above objects have been achieved according to the invention by the arrangement of a single blower centrally in or on the drying chamber in such a way that the blower forms a venting or drying gas circulating unit which includes a compression chamber and a suction chamber for the gaseous drying medium, whereby these chambers are separated from one another, and wherein horizontally extending suction channels are arranged directly below and directly above the back flow zone of the nozzle sets, preferably slotted nozzle sets. The suction channels of the lower and upper nozzle sets, such as slotted nozzle sets, lead through respective channels into a return flow central suction channel. The return flow central suction channel extends below a heat insulated upper chamber wall carrying the venting unit, across the drying chamber, in other words, in parallel to the cross axis of the drying chamber. The return flow suction channel is connected with the suction chamber of the venting unit. Vertically extending air guide channels are arranged near the end walls of the drying chamber. The lower free ends of these vertical air guide channels are directly connected to the lower suction channels, while the upper free ends of the vertical air guide channels are connected with the return flow central suction channel through a channel intermediate section having a Y-configuration. The vertical sections are located in chamber corners.

Advantages of the heat treating apparatus according to the invention reside in the fact that the gaseous heat treating medium is forced to follow a defined return suction path so that there is no possibility for the gaseous medium to flow in an uncontrolled manner from one drying area or zone to another. The definitely controlled return flow according to the invention also makes sure that on the air inlet side, the temperature of the incoming treatment medium cannot be adversely influenced by the returning treatment medium which may have a temperature different from the temperature of the incoming treatment medium. Still another advantage is seen in that compared to the prior art, the use of a single blower for each drying chamber reduces costs compared to the use of at least two such blowers. The arrangement of a central venting unit also simplifies the overall construction. The treatment medium may be heated by steam, whereby an oil burning or electrical furnace may be used. However, the heating of the treatment medium could be accomplished by other heating means, for example, a direct or indirect gas heating device.

BRIEF DESCRIPTION OF THE DRAWINGS

In order that the invention may be clearly understood, it will now be described, by way of example, with reference to the accompanying drawings, wherein.

DETAILED DESCRIPTION OF A PREFERRED EXAMPLE EMBODIMENT AND OF THE BEST MODE OF THE INVENTION

Figure 1:
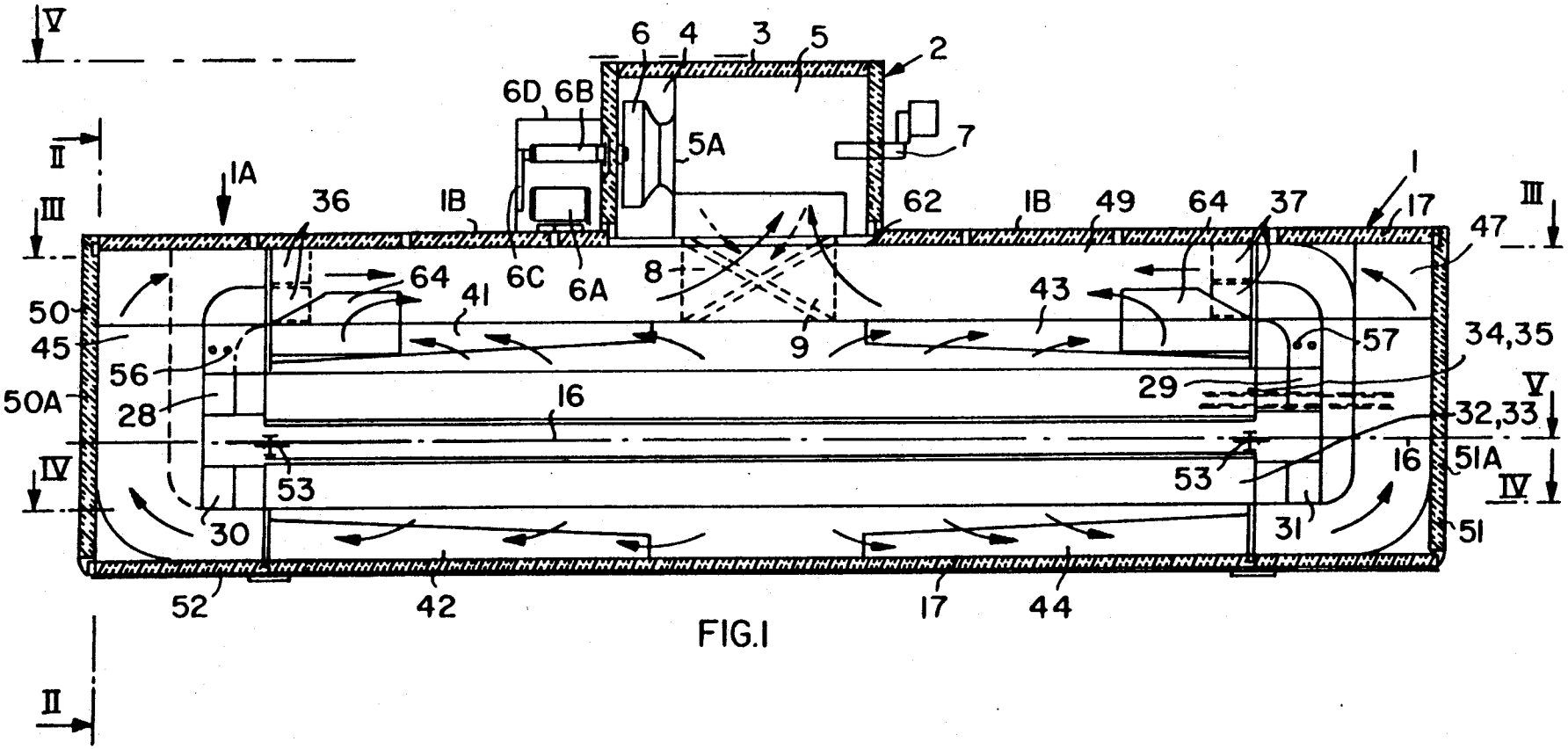
FIG. 1 is a sectional view along section line I—I through a treatment chamber according to the invention, as shown in FIG. 3, illustrating the centrally arranged venting unit, whereby the section plane extends perpendicularly to the feed advance direction of a material web to be treated in such a chamber.
Figure 2:
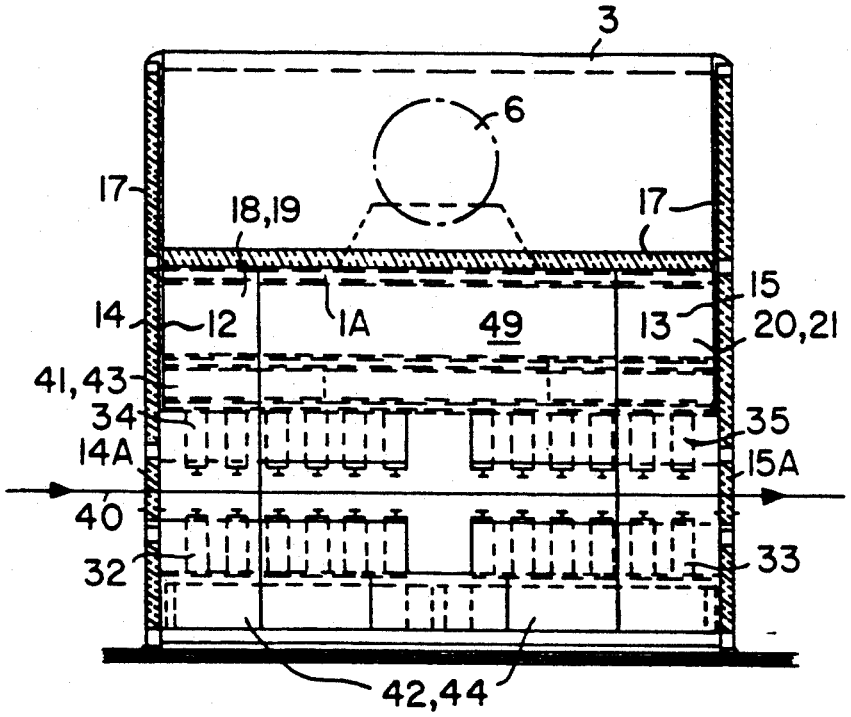
FIG. 2 is a sectional view along section line II—II in FIG. 1.
Figure 3:
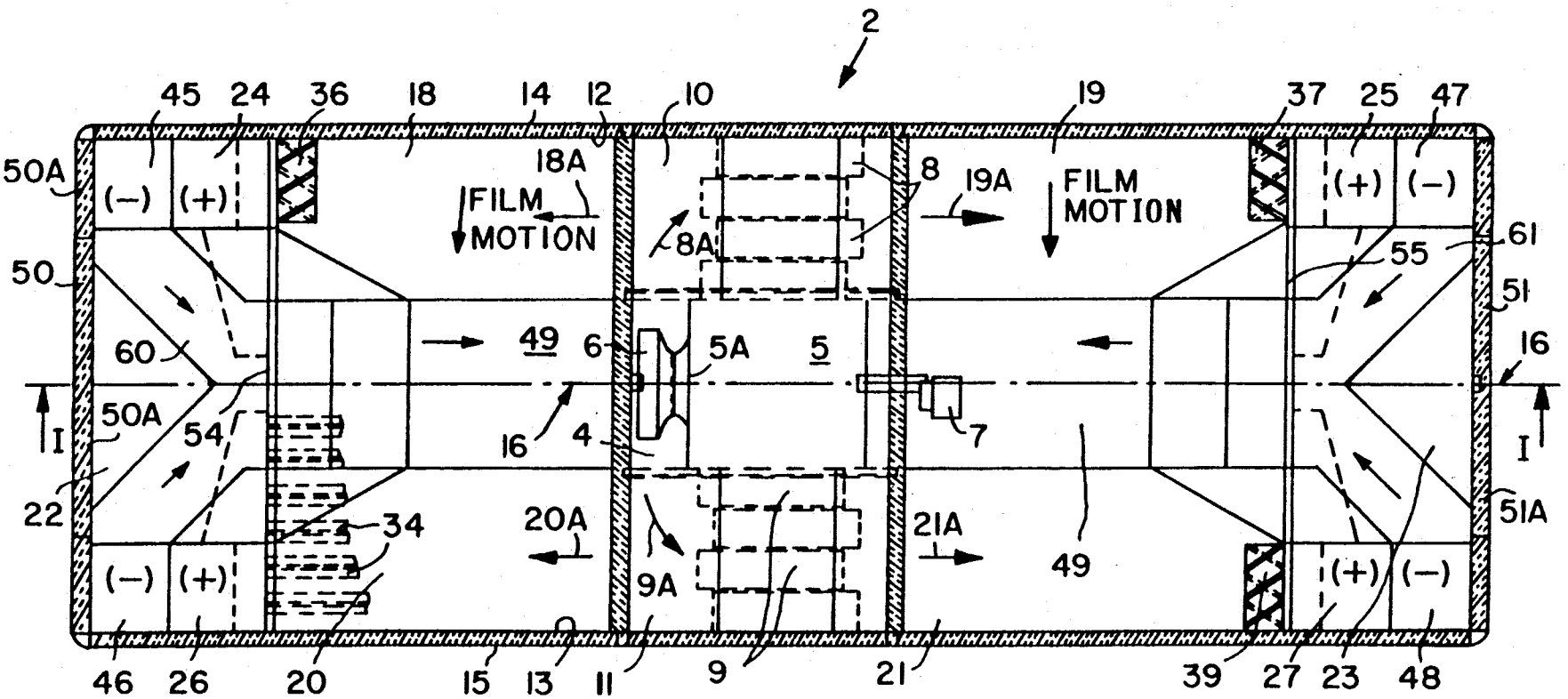
FIG. 3 is a sectional view along section line III—III in FIG. 1.

Referring to FIGS. 1 to 5 in conjunction, these figures illustrate but one drying chamber. It is to be understood, that a plurality of identical chambers as disclosed herein can be assembled in a row to form a drying system, whereby a web or film 40 travels sequentially through all chambers of such a system. The chamber 1 is enclosed by a top wall 1A, a bottom 52, two side walls 50 and 51 interconnecting the top and bottom walls, by an entrance wall 14 and by an exit wall 15. The entrance wall 14 and the exit wall 15 are shown in FIGS. 2,3. All the walls and the bottom are heat insulated as shown at 17. The top wall 1A is preferably assembled from a plurality of wall sections 1B, which are interlocked in a conventional manner. Similarly, the side walls 50 and 51 are preferably assembled of respective wall sections 50A and 51A. The entrance wall 14 is provided with an entrance slot 14A for the entrance of a material web or film 40 into the drying chamber 1 as best seen in FIG. 2. The exit wall 15 is provided with an exit slot 15A for the exit of the web or film 40. In FIG. 2 the film 40 travels from left to right which means that in FIG. 1 the film 40 travels toward the viewer perpendicularly to the plane defined by the sheet of the drawing. Web guide elements 53 of conventional construction are arranged in the chamber 1 for guiding the web or film 40 through the chamber. The web 40 travels horizontally and at a right angle to the crosswise axis 16 through the chamber 1, FIG. 3.

FIG. 1 shows a venting unit 2 having a housing 3 divided into a compression chamber 4 and a suction chamber 5 by a divider wall 5A. A blower 6, for example, in the form of a radial compressor, is arranged in the housing 3 so that its intake is located in the suction chamber 5 while its outlet is located in the compression chamber 4. A heater 7, for example, equipped with a gas burner, is arranged to heat the gaseous treatment medium in the suction chamber 5. The treatment medium is normally air and hence reference will be made to air in the following description.

The air heated in the suction chamber 5 enters into the blower 6 and is discharged into the compression chamber 4 which is connected to air mixing chambers 10 and 11 of the venting unit 2 as best seen in FIG. 3. The air mixing chamber 10 leads into static air mixing elements 8. The air mixing chamber 11 leads into static air mixing elements 9. This travel of the compressed heated air into air mixing elements 8 is indicated by the arrow 8A and into air elements 9 by the arrows 9A. The air mixers 8 lead into an air distribution channel 18 as indicated by the arrow 18A. The mixers 8 also lead into an air distribution channel 19 as indicated by the arrow 19A. Further, the mixers 9 lead into an air distribution channel 20 as indicated by the arrow 20A and into an air distribution channel 21 as indicated by the arrow 21A. These air distribution channels 18 and 19 are arranged alongside the entrance wall 14 and alongside the top wall 1A. Thus, the inner surface 12 of the entrance wall 14, and the inner surface of the top wall 1A define part of the enclosure of the distribution channels 18 and 19. Similarly, the inner surface of the exit wall 15 and the inner surface of the top wall 1A form part of the distribution channels 20 and 21.

Referring to FIG. 3, the zones inside the housing 1 near the end walls 50 and 51 are referred to as the channel distribution zones 22 and 23, respectively. Vertically arranged air guide ducts or channels 24, 26 and 45 and 46 are arranged in the zone 22. Further vertical air guide channels or air ducts 25, 26, 47, and 48 are arranged in the zone 23. A static air mixer 36, 37, 39 is arranged in the transition area between the respective air distribution channel and the corresponding vertical air duct or distribution channel. More specifically, channel 18 leads through the mixer 36 into the vertical air distribution channel 24. Channel 19 leads through the mixer 37 into the channel 25. Channel 21 leads through the mixer 39 into the channel 27. Channel 20 leads through a further mixer, not shown into the channel 26. The (+) in the channels 24, 25, 26, and 27 indicates that the air in these channels is compressed air. Similarly, the (−) in vertical channels 45, 46, 47, and 48 indicates that suction air travels through these channels.

The individual flow channels are as follows: Air passing through the distribution channel 18 and the mixer 36 comes through the channel 24 into a duct 28 leading into a nozzle set 32. Air from the channel 19 passing through the mixer 37 flows through the channel 25 through a duct 29 into a nozzle set 32. Air from the channel 20 also passes through a mixer in the channel 26 into a duct 30 leading into a nozzle set 34. Air from the channel 21 passes through the mixer 39 into the channel 27 leading into a duct 31 which in turn supplies the air into the nozzle set 35. The purpose of the static mixer 36, 37, 39 is to increase the uniformity of the temperature distribution throughout the volume of the treatment air. The treatment air passes out of the nozzle sets 32, 33, 34, 35 as shown in FIG. 2 to contact the material web or film 40, for example, a synthetic material film. Generally, arrows indicate the flow direction.

Due to the fact that the nozzle sets 32, 33, 34, and 35 are arranged symmetrically to both sides of the chamber axis 16, and are symmetrically charged with air through the distribution ducts 28, 29, 30, and 31, a pressure equalization takes place in the individual nozzles of the nozzle sets, whereby a uniform blowing-out flow speed is achieved along the entire nozzle width and thus across the entire film or web width.

The air passing out of the nozzle sets 32, 33, 34, and 35 is sucked out of the spaces between the nozzle sets and the surface of the film 40, for return into the suction chamber 5. More specifically, the air from the lower nozzle sets 32, 33 is sucked downwardly into suction channels 42, 44. The air from the upper nozzle sets 34, 35 is sucked upwardly into suction channels 41, 43. Due to the free cross-sectional flow area between the nozzles and the material web, the air speed of the suction air is less than 1 m/s. The lower suction channels 42, 44 are connected through the above mentioned return channels 45, 46, 47, 48 vertically installed in the corners of the chamber 1 as shown in FIGS. 1 and 3, with the return suction areas of the upper nozzle sets 34, 35. The return channels or ducts 45 to 48 lead into a return flow central suction channel section 49 located below the top wall 1A with its insulation 17. The central suction channel 49 returns the suction air into the suction chamber 5 of the venting unit 2, where the radial blower 6 returns the air into the circulating circuit. Incidentally, the blower 6 is driven by a motor 6A connected to a gear drive 6B, for example, through a pulley drive 6C arranged in a housing 6D mounted next to the housing 3 of the venting unit 2.

The production of high quality films, such as polyester films, as well as polypropylene condenser films, makes it necessary to install air filters in the path of the compression air prior to its discharge onto the film being treated, to make sure that the air contacting the film is free of dust. For this purpose, filters not shown are installed in the air distribution channels 18, 19, 20, and 21. In these areas there is sufficient space to install the required filter volume. Preferably, the filters are so positioned that the air passing into the static mixers 36, 37, 39 has already passed through the filters. The filters as such are conventional.

As mentioned above, a plurality of treatment chambers can be arranged in series, whereby the outlet of one chamber leads directly into the inlet of the next chamber. The feed advance means for transporting the film or web are not shown, since they are not part of the invention. Due to the substantially closed construction of each chamber, the air flow and air temperature control in each chamber is independent of that in any of the other chambers of a system so that a highly individualized control of the drying air can be achieved in each chamber for treating, for example, thermoplastic synthetic material films.

The above mentioned distribution zones 22 and 23 in the chamber 1 near the lateral ends thereof, are separated from the inner chamber space by divider wall members 54, 55. These wall members 54, 55 may be made of sheet metal and are spaced from one another in the direction of the axis 16 in accordance with the width of the web or film 40. The guide members 53 for the web are located inside the separator walls 54, 55. As described above, two upper nozzle sets 34 and 35 and two lower nozzle sets 32 and 33 are arranged within the space between the separator walls 54, 55. Each nozzle set has, for example, six or four individual nozzles, depending on the length of the individual drying zone as viewed in the motion direction of the film 40. The above mentioned distribution channels 28, 29, 30, 31 combine the respective nozzle sets so that all nozzles of a set are supplied by the respective distribution channel. Due to the mentioned symmetric arrangement of the channels 28, 29 on the one hand, and 30 and 31 on the other hand, an air equalization above and below the web or film 40 is accomplished which results in a uniform treatment due to the highly uniform air supply on both sides of the web.

Referring to FIG. 2, the upper nozzle set 34 is spaced from the upper nozzle set 35 in the direction of the travel of the web or film 40 to provide an access space between the two nozzle sets above the film 40. Such access space permits maintenance work and control operations in the area where the film travels, whereby, for example, film scraps may be removed even during operation of the apparatus.

The two lower nozzle sets 32 and 33 are arranged below the film or web 40 and are also spaced to leave an access spacing between the two sets in the direction of film motion.

Referring to FIG. 3, the distribution channels 24, 25, 26, 27 vertically arranged in the respective channel guide zones 22, 23 for supplying the heated air to the upper nozzle sets 34, 35 and to the lower nozzle sets 32 and 33, are constructed as double channels to supply the hot air to all nozzles above and below the film. Referring to FIG. 1, air flow control flaps 56, 57 are arranged in the vertical channel section leading to the upper nozzle sets 34 and 35. These air flow control flaps make it possible to adjust the pressure between the upper and lower nozzle sets 34, 35 on the one hand and 32, 33 on the other hand, whereby the uniform air distribution can be optimally adjusted.

Figure 4:
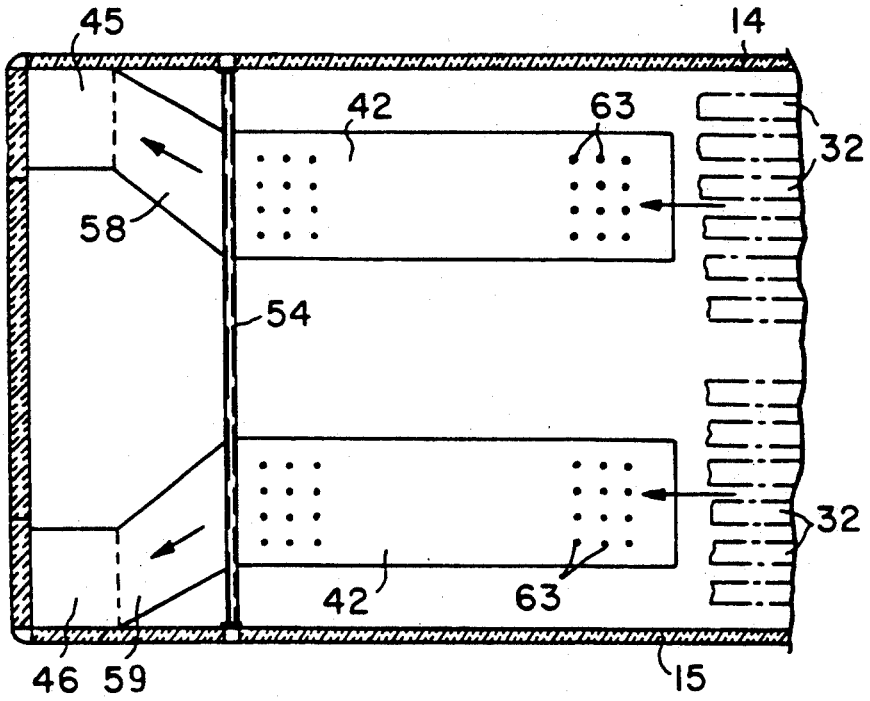
FIG. 4 is a sectional view along section line IV—IV in FIG. 1.
Figure 5:
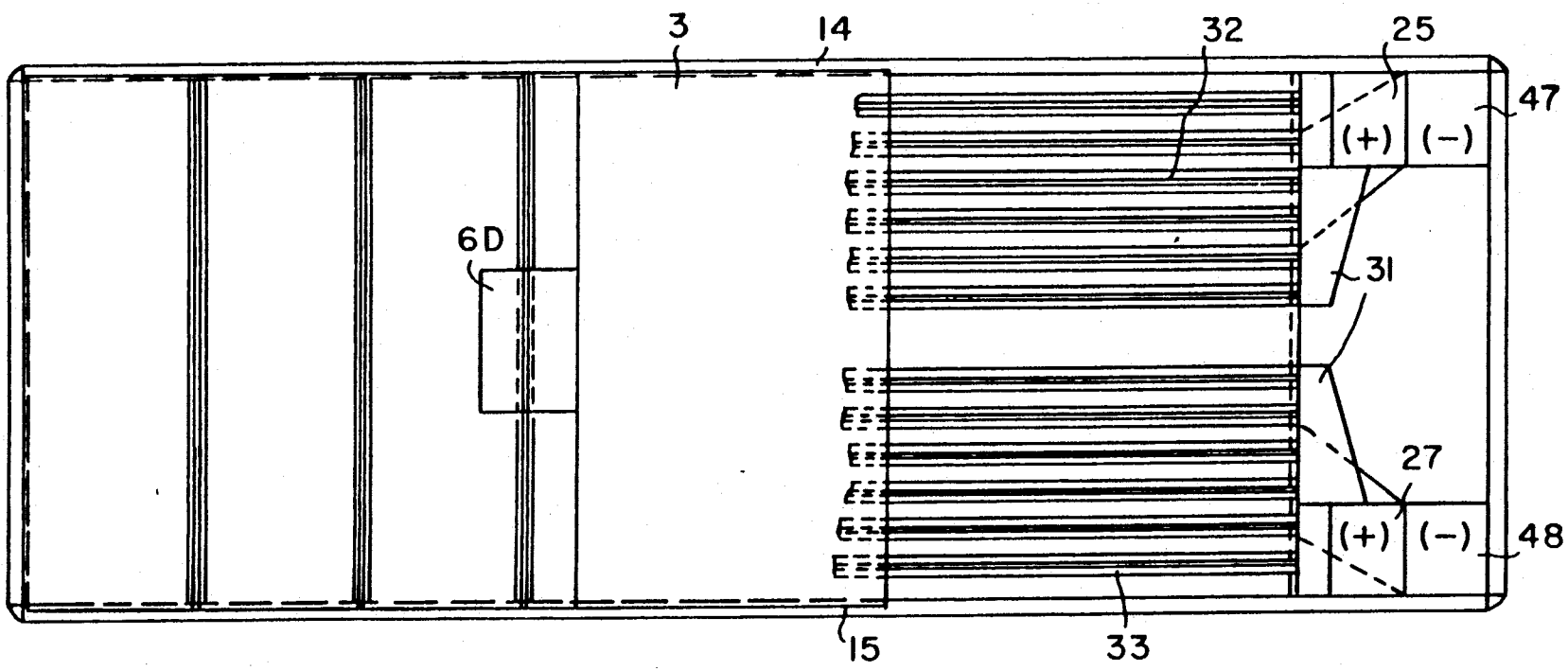
FIG. 5 is a sectional view along section line V—V in FIG. 1.

The vertically arranged return channels 45, 46, 47, 48 are arranged in the corner of the housing 1 as best seen in FIGS. 3 and 4. The channel 45 is connected through an elbowed duct section 58 to its suction nozzle set 42. The channel section 46 is connected through an elbowed duct section 59 to its suction nozzle set 42. The other vertical channel sections 47, 48 are similarly connected. A Y-shaped intermediate duct section 60, 61 connects the upper end of the respective channels 45, 46 and 47, 48 with the central suction return channel section 49 which is located below the top wall 1A. The central return suction channel section 49 communicates with the suction chamber 5 of the venting unit 2 through an air filter 62. However, the filter may not be necessary, depending on the type of heating. If a filter 62 is not used, the chamber 5 is directly connected with the channel section 49 through an opening in the top wall below the housing 3.

The upper and lower nozzle sets 32, 33, 34, 35 are arranged horizontally and so are the respective suction channels 41, 42, 43, 44, whereby the nozzle sets and suction channels are so dimensioned that there is a substantial overlap or register between the respective nozzle set and suction channel. The suction nozzle 63 shown in FIG. 4 may either be round holes or slotted nozzles. These nozzles are so dimensioned that they assure a uniform and well defined withdrawal of the treatment air coming out of the nozzle sets 32 to 35 for returning this air to the suction chamber 5 as described.

Although the invention has been described with reference to specific example embodiment it will be appreciated that it is intended to cover all modifications and equivalents within the scope of the appended claims.

What we claim is:

1. An apparatus for treating a flat material web with a gaseous treatment medium, comprising means having a central cross-axis (16) for substantially enclosing a treatment chamber, an inlet slot in said housing means for passing a material web into said treatment chamber, an outlet slot in said housing means for withdrawing said material web from said treatment chamber in a defined web motion direction, treatment means arranged for applying said treatment medium to a surface of said material web, said treatment means comprising blowing slot nozzle means for blowing treatment medium onto a surface of said material web, said blowing nozzle means extending across said material web motion direction and having blowing slot nozzles facing said material web, said treatment means further comprising a venting unit (2) including a single blower (6) centrally mounted relative to said housing means, a compression chamber in said venting unit communicating with a blower outlet, a suction chamber in said venting unit communicating with a blower inlet, said treatment means further comprising first flow guide means including two treatment medium mixing chambers (10, 11), one of said mixing chambers being arranged on one side of said single blower, the other of said two mixing chambers being arranged on the other side of said single blower, both mixing chambers being arranged in parallel to said central cross-axis (16) of said housing means on opposite sides of said cross-axis (16), said first flow guide means comprising distribution channels (18, 19, 20, 21; 24, 25, 26, 27) communicating said mixing chambers with said blowing nozzle means (32, 33, 34, 35) in said housing means, said treatment means further comprising suction channel means including suction nozzles communicating with said blowing slot nozzles for removing treatment medium from said web, and second flow guide means leading in said housing means to said suction chamber from said suction channel means for returning treatment medium to said suction chamber, said first and second flow guide means forming together with said single blower a substantially closed treatment medium circulating circuit, and wherein said second flow guide means include a return flow central suction channel (49) leading to said suction chamber, said second flow guide means leading into said central suction channel, whereby used treatment medium must follow a defined suction path in a controlled manner and cannot adversely influence a temperature of incoming treatment medium.

2. The apparatus of claim 1, wherein said blowing nozzle means comprise a first plurality of blowing nozzle sets arranged above said material web and having blowing nozzles facing downwardly onto an upper surface of said material web, and a second plurality of blowing nozzle sets arranged below said material web and having blowing nozzles facing upwardly onto a lower surface of said material web.

3. The apparatus of claim 2, wherein said blowing nozzles are slot nozzles extending substantially in parallel to the respective web surface.

4. The apparatus of claim 1, wherein said return flow central suction channel is located substantially centrally below a top wall in said housing means, and wherein said first flow guide means comprise flow channel sections arranged on each side of said return flow central suction channel.

5. The apparatus of claim 1, wherein said housing means comprise heat insulated housing wall sections.

6. The apparatus of claim 1, wherein said blowing nozzle means comprise a first plurality of blowing nozzle sets arranged above said material web and having blowing nozzles facing downwardly onto an upper surface of said material web, and a second plurality of blowing nozzle sets arranged below said material web and having blowing nozzles facing upwardly onto a lower surface of said material web, wherein said suction channel means comprise upper suction channels communicating with said first nozzle sets, and lower suction channels communicating with said second nozzle sets, and wherein said return flow central suction channel is connected through said second flow guide means to said upper suction channels and to said lower suction channels, whereby said upper suction channels and said lower suction channels are separately connected to said return flow central suction channel.

7. The apparatus of claim 6, wherein said second flow guide means comprise first feed pipe sections (64) connecting said upper suction channels to said return flow central suction channel.

8. The apparatus of claim 6, wherein said second flow guide means comprise vertically arranged duct sections and elbowed duct sections connecting said lower suction channels to said return flow central suction channel.

9. The apparatus of claim 1, wherein said return flow central suction channel (49) is located centrally directly below a top wall of said housing means, said central suction channel (49) extending parallel to said central cross-axis of said housing means, said housing means further comprising heat insulating means for heat insulating at least said top wall.

10. The apparatus of claim 9, wherein said second flow guide means further comprise vertical duct section and Y-configuration flow duct members for connecting free ends of said central suction channel to said vertical duct sections leading to said suction channel means.

* * * * *

UNITED STATES PATENT AND TRADEMARK OFFICE

CERTIFICATE OF CORRECTION

PATENT NO. : 5,191,725

DATED : March 9, 1993

INVENTOR(S) : Horst Wohlgenannt et al.

It is certified that error appears in the above-identified patent and that said Letters Patent is hereby corrected as shown below:

Column 7, claim 1, line 2, after "comprising" insert --housing--;

Column 8, claim 10, line 2, replace "section" by --sections--.

Signed and Sealed this

Twenty-third Day of November, 1993

Bruce Lehman

*Attest:*

BRUCE LEHMAN

*Attesting Officer*

*Commissioner of Patents and Trademarks*